US006685546B1

(12) United States Patent
Del Raso

(10) Patent No.: US 6,685,546 B1
(45) Date of Patent: Feb. 3, 2004

(54) AUTOMATIC ABRASIVE SLEEVE TIGHTENING MEANS AND QUICK RELEASE SYSTEM FOR AN OSCILLATING SPINDLE SANDER

(76) Inventor: Americo Del Raso, 21858 River Oaks Dr., Apt. 3F, Rocky River, OH (US) 44116

( * ) Notice: Subject to any disclaimer, the term of this patent is extended or adjusted under 35 U.S.C. 154(b) by 0 days.

(21) Appl. No.: 10/412,770

(22) Filed: Apr. 14, 2003

Related U.S. Application Data

(63) Continuation-in-part of application No. 09/909,935, filed on Jul. 21, 2001, now Pat. No. 6,547,654.
(60) Provisional application No. 60/220,214, filed on Jul. 22, 2000.

(51) Int. Cl.[7] ..... B24B 23/02
(52) U.S. Cl. ..... 451/356; 451/357; 451/358; 451/441; 83/666
(58) Field of Search ..... 451/441, 357, 451/358, 356; 279/131, 2.1, 75, 22, 30; 409/233; 83/666, 698.4; 30/394–392

(56) References Cited

U.S. PATENT DOCUMENTS 3,691,900 A * 9/1972 Novak et al. ..... 409/233
4,115,018 A * 9/1978 Siegler et al. ..... 408/239 A
4,148,692 A * 4/1979 Chu et al. ..... 201/36
4,209,182 A * 6/1980 Sheldon ..... 279/75
4,566,511 A * 1/1986 Robinson ..... 144/48.6
4,657,428 A * 4/1987 Wiley ..... 403/359.3
4,989,374 A * 2/1991 Rudolf et al. ..... 451/342
5,157,873 A * 10/1992 Rudolf et al. ..... 451/342
5,564,971 A * 10/1996 Evensen ..... 451/504
6,439,985 B2 * 8/2002 Rogers et al. ..... 451/442
6,547,654 B2 * 4/2003 Del Raso ..... 451/441
6,554,290 B2 * 4/2003 Lin ..... 279/72
6,569,002 B2 * 5/2003 Smith et al. ..... 451/357
6,623,220 B2 * 9/2003 Nuss et al. ..... 408/204

* cited by examiner

*Primary Examiner*—George Nguyen
(74) *Attorney, Agent, or Firm*—John D. Gugliotta; Olen L. York, III

(57) ABSTRACT

A quick release system for an oscillating spindle sander comprises a linearly elongated shaft inserted and housed within a cavity of a sanding drum. A top washer comprising a central aperture and a pair of downwardly projecting prongs aligned about a circumference of the central aperture and insertable into notches formed within the top of the shaft. A pin assembly is insertable into the shaft to impinge the top washer with the sanding drum, thereby compressing an abrasive sanding sleeve placed onto said sanding drum and permitting sanding of an object. The pin assembly may be released and removed from the shaft, permitting removal of the top washer. Upon removal of the top washer, the abrasive sanding sleeve may be removed and disposed of, or inverted so as to use the unused portion of the sanding sleeve, and thus extending the useful life of the sleeve.

11 Claims, 9 Drawing Sheets

AUTOMATIC ABRASIVE SLEEVE TIGHTENING MEANS AND QUICK RELEASE SYSTEM FOR AN OSCILLATING SPINDLE SANDER

RELATED APPLICATIONS AND DISCLOSURES

The present application is a Continuation-In-Part of U.S. Ser. No. 09/909,935 filed Jul. 21, 2001, presently embodied in issued U.S. Pat. No. 6,547,654, issued on Apr. 15, 2003 which claimed the benefit of U.S. Provisional Patent Application No. 60/220,214, filed on Jul. 22, 2000.

BACKGROUND OF THE INVENTION

1. Field of the Invention

The present invention relates generally to an oscillating spindle sander, and more particularly, to an oscillating spindle sander with an automatic abrasive sleeve tightening means and a safety release for quickly extracting items or objects caught in the sander.

2. Description of the Related Art

Oscillating spindle sanders are well known in the prior art, embodied in a variety of configurations, including table models and portable, hand-held models. One example of the art is Sears Craftsman Oscillating Spindle Sander Model No. 113.225306, wherein an on and off switch engages and disengages, respectively, a motor for oscillating a cylindrical sander for sanding objects.

The oscillating spindle sanders that have developed require manual loosening and tightening of a nut for installation or removal of the abrasive sleeve. This is generally done by tightening or loosening the nut over the top washer above the sanding drum. This manual adjustment requires additional tools and time, as well as an estimation on the part of the user with regard to whether the abrasive sleeve is tight enough. Furthermore, there is a risk of over-tightening the nut that may result in stripping of the nut and bolt, thereby rendering the sander inoperable and requiring expensive maintenance to restore use to the sander. Consequently, a need exists for an automatic means by which the abrasive sleeve is accurately tightened and avoiding the risks and problems described above. The present invention fulfills this need.

In addition, if the user gets his/her hair or clothing caught in the sander, he/she is forced to try and reach either an on/off switch on the motor or to reach the power plug and disconnect the sander from its power source in order to stop the spindle shaft, the sanding drum and the abrasive sleeve from turning. The development of a quick-release mechanism permits a user to disengage the sanding drum and abrasive sleeve from the spindle shaft, momentarily, so as to extricate the object caught within the sander.

Further, it is recommended that users of oscillating spindle sanders, in order to reduce economic waste, remove and invert the abrasive sleeve once before discarding. Because of the hassle associated with removing and inverting the abrasive sleeve, many users simply discard the sleeve without maximizing the useful life of the sleeve.

Consequently, a need exists for a system that allows a user to quickly release the abrasive sleeve and drum from spinning, thereby allowing the user to extricate the object caught in the sander. A further need exists for a system that allows the abrasive sleeve to be quickly and easily removed, inverted and replaced. The present invention fulfills each of these needs.

SUMMARY OF THE INVENTION

The present invention, an oscillating spindle sander with automatic abrasive sleeve tightening means and quick release system operates as an improvement to current oscillating spindle sanders commercially available. In most oscillating spindle sanders, the abrasive sleeve must be manually tightened. The present invention incorporates an automatic tightening means consisting in part of a flyweight assembly that works to tighten the abrasive sleeve against the sanding drum of the oscillating spindle sander as soon as the motor of the sander is activated. An alternative embodiment of the flyweight assembly is devised to convert or modify existing oscillating spindle sanders into an apparatus similar to that disclosed herein.

The present invention also incorporates a quick release system to be used in conjunction with a standard oscillating spindle sander or with an oscillating spindle sander with the automatic abrasive sleeve tightening means disclosed herein. The quick release system is comprised of a pin assembly that is used to lock down or release, respectively, the upper washer located at the top portion of the sanding drum. When activated, the quick release system releases said washer allows the abrasive sleeve and sanding drum to loosen, thereby allowing the user to extricate the item caught within the sander. The pin assembly also allows for quick and easy removal and replacement of the abrasive sleeve whenever necessary or desired.

It is an object of the present invention to provide an automatic abrasive sleeve tightening means for an oscillating spindle sander such that the user does not have to manually tighten the abrasive sleeve.

It is a further object of the present invention to provide an automatic abrasive sleeve tightening means for an oscillating spindle sander such that activation of the sander automatically tightens the abrasive sleeve about the sanding drum.

It is a further object of the present invention to provide a quick release system for an oscillating spindle sander such that if an item of a user is caught in the oscillating spindle sander, the user can quickly release the abrasive sleeve and sanding drum, thereby breaking free of the sander without having to reach the on/off switch on the motor, the electrical plug, or otherwise risking further injury to self or someone close by.

It is another object of the present invention to provide a quick release system that allows for quick and easy removal and replacement of the abrasive sleeve.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 10*a* and FIG. 10*b* are elevational views with the sanding drum removed for clarity, wherein FIG. 10*a* is the resting position of the apparatus, and FIG. 10*b* is a representation of the apparatus in use (with the spring removed for clarity), with the flywheels having moved outward from the shaft, and the dome plate having risen vertically above its starting position (indicated by the broken lines between the two figures).

DESCRIPTION OF THE PREFERRED EMBODIMENTS

The best mode for carrying out the invention is presented in terms of its preferred embodiment, herein depicted within the FIGS. 1 through 10*b*.

1. Detailed Description of the Figures

Figure 1:
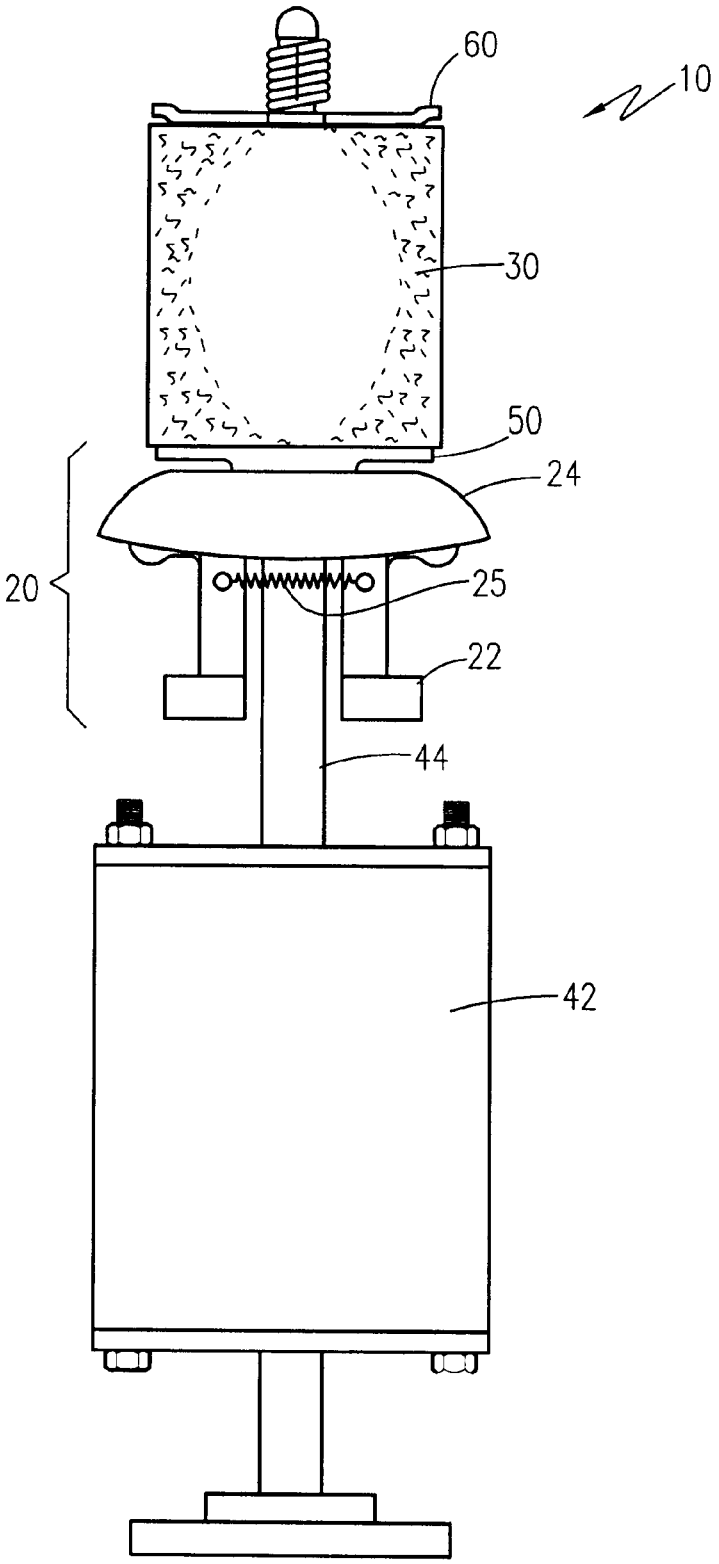
FIG. 1 is an elevational view of an oscillating spindle sander with a quick release system incorporated therein.
Figure 2:
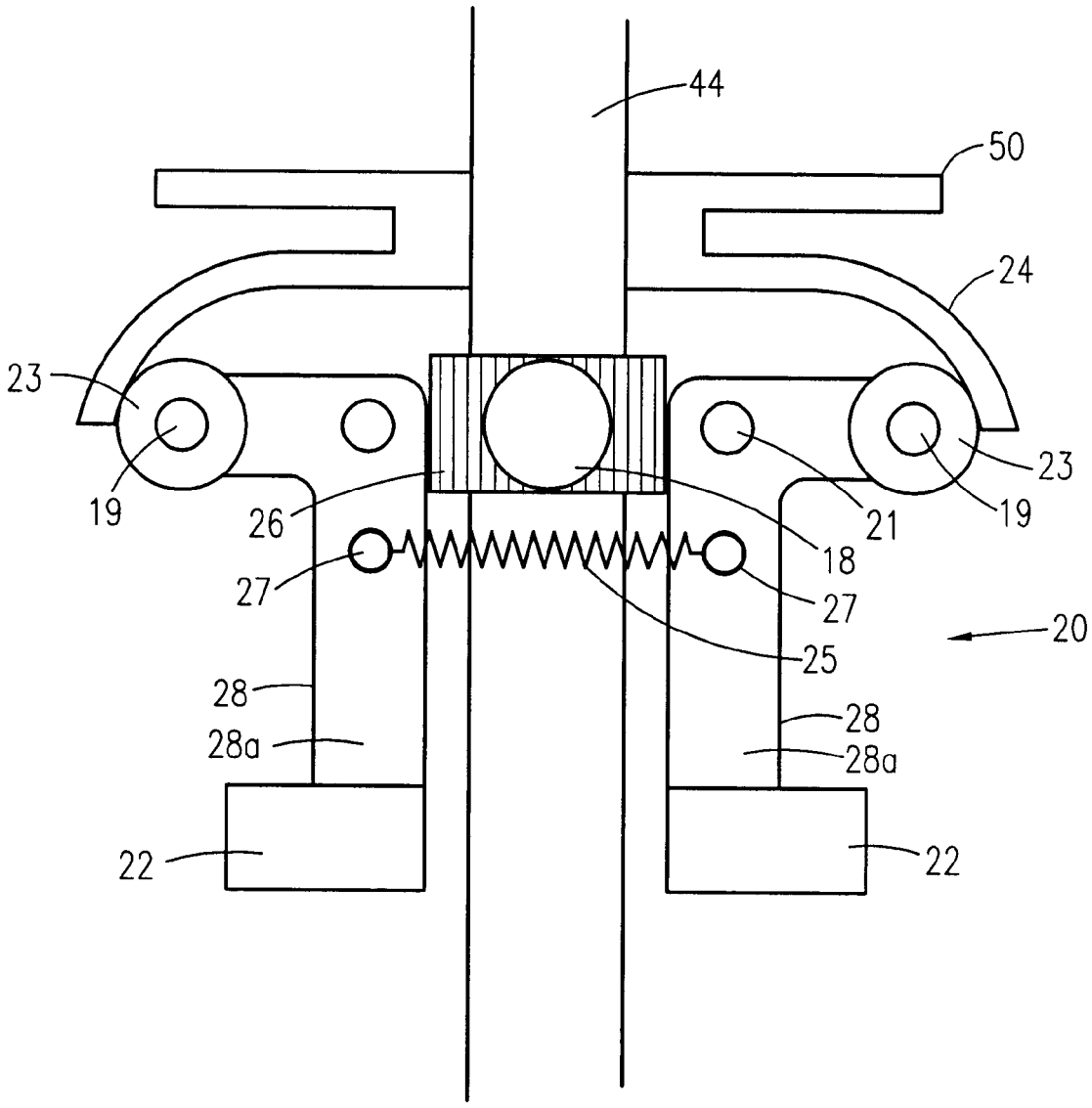
FIG. 2 is an elevational view of the automatic abrasive sleeve tightening means.
Figure 3:
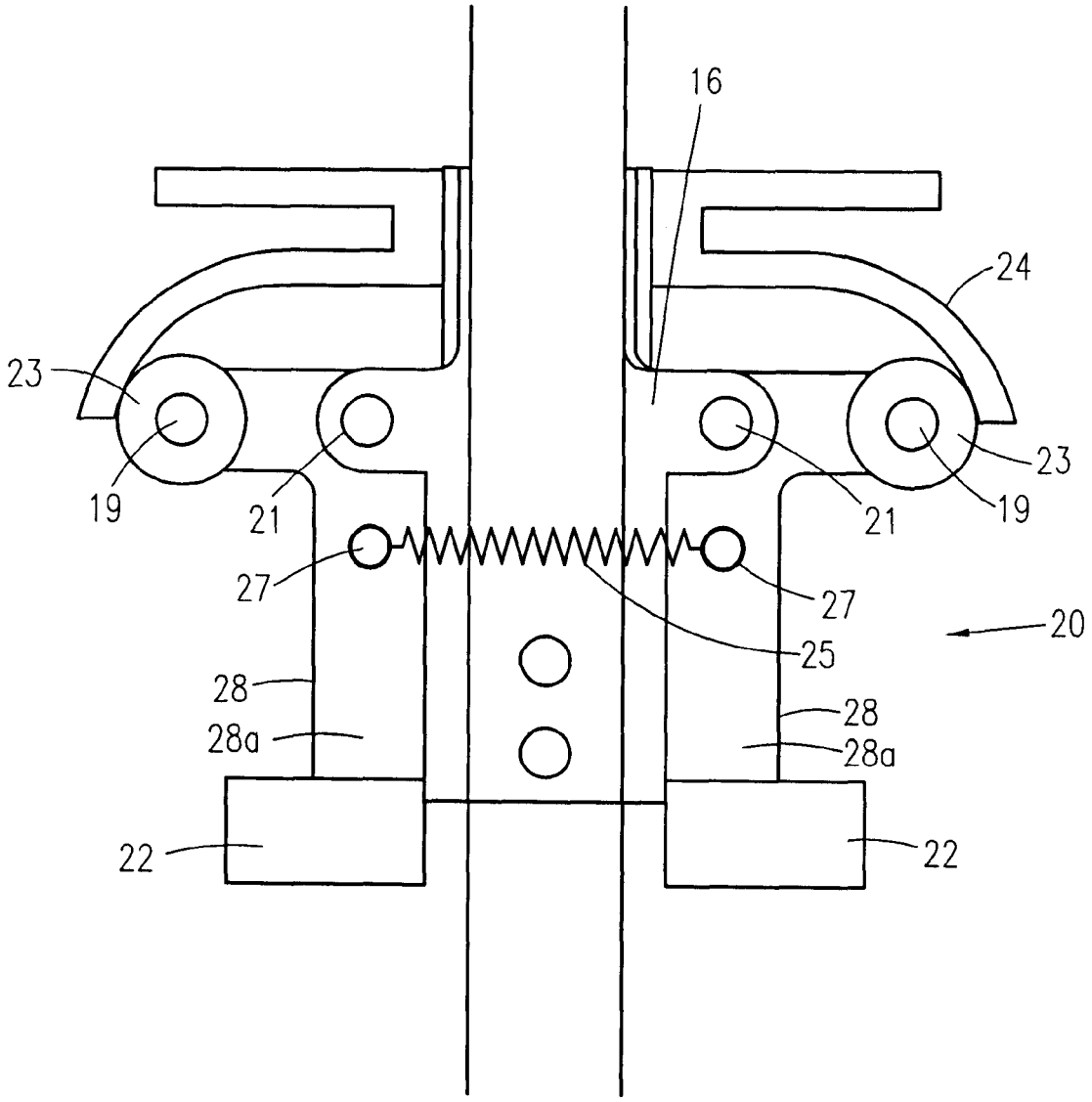
FIG. 3 is an elevational view of an alternative embodiment of the automatic abrasive sleeve tightening means.
Figure 4:
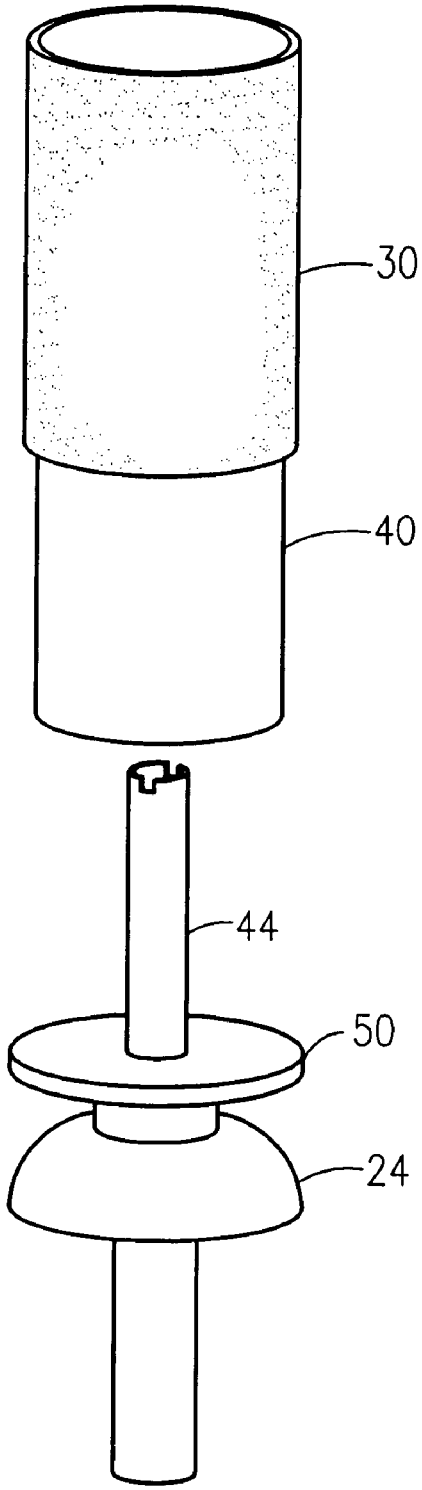
FIG. 4 is an exploded perspective view of the tightening means, including the abrasive sleeve partially placed onto the sanding drum, and a shaft that communicates with the sanding drum.
Figure 5:
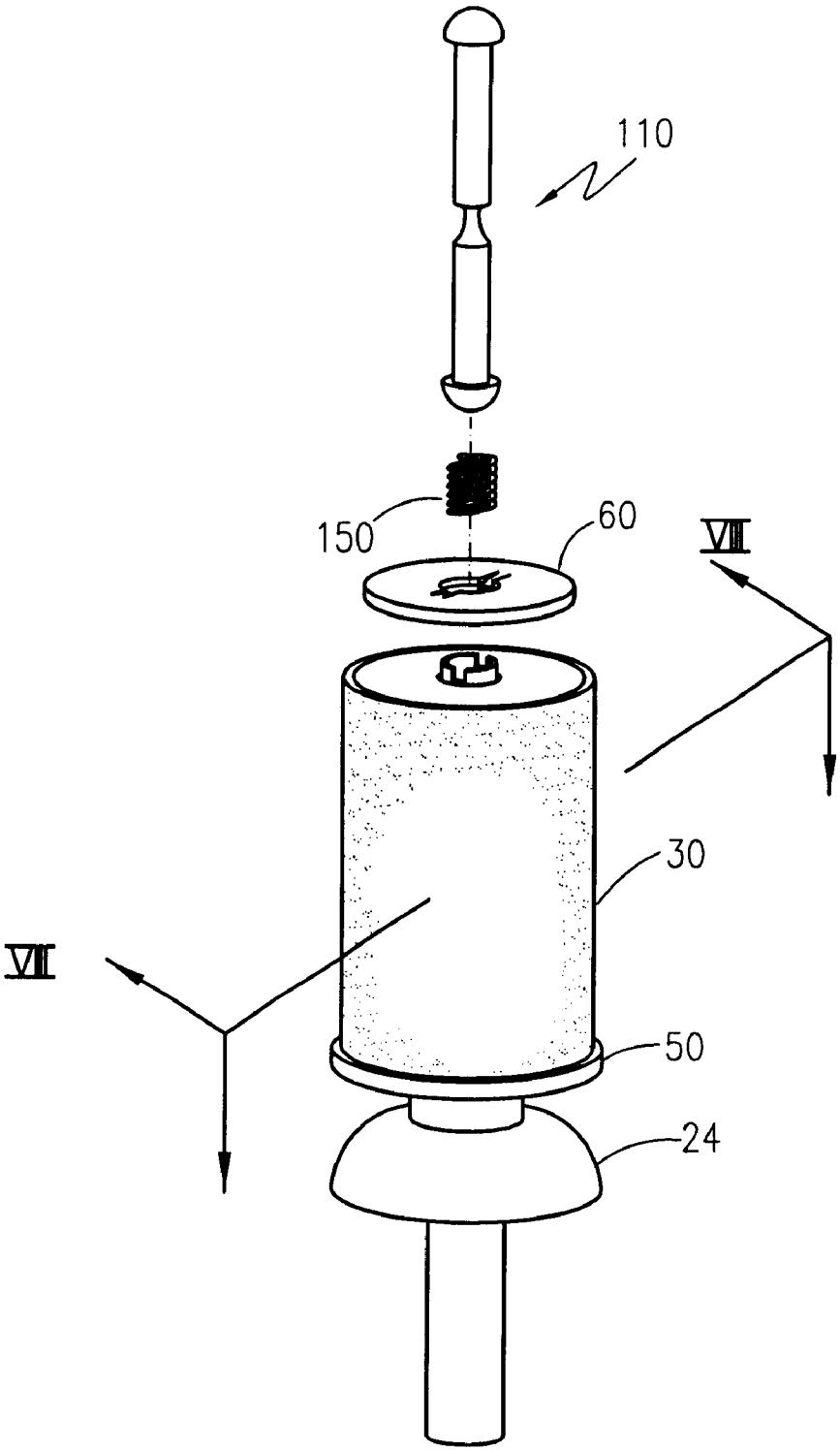
FIG. 5 is an exploded perspective view of the abrasive sleeve secured to the sanding drum, with a top washer, spring and pin assembly partially extracted to indicate the spatial arrangement of the respective components.
Figure 6A:
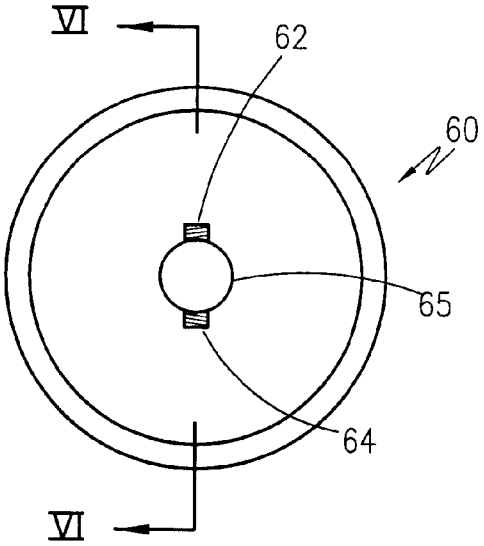
FIG. 6*a* is a bottom view of the top washer illustrating the central aperture and the pair of downwardly projection prongs.
Figure 6B:
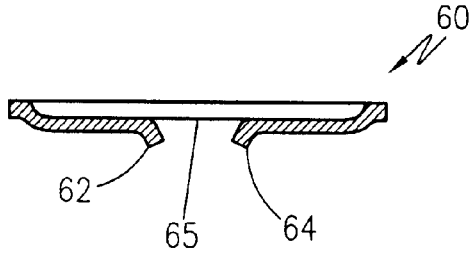
FIG. 6*b* is a partial cross-sectional view of the top washer taken along line VI—VI of FIG. 6*a;*
Figure 7A:
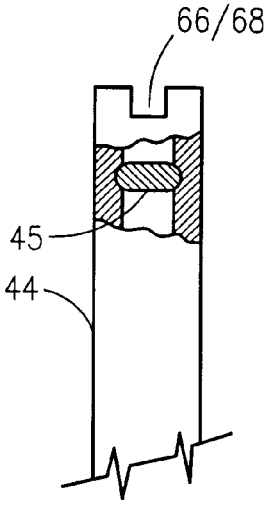
FIG. 7*a* is an elevational view of the spindle shaft, shown in partial section view also to indicate the placement of the shaft openings to receive ball bearings impinged therein by the vertical alignment of the shaft.
Figure 7B:
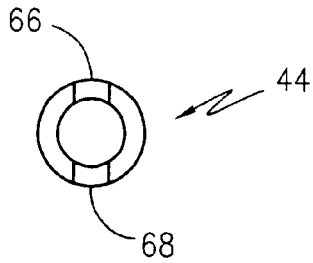
FIG. 7*b* is a top view of the spindle shaft illustrating the notches provided to receive the prongs from the top washer.

Referring now to FIG. 1 through FIG. 3, an oscillating spindle sander 10 is shown with the present invention, a abrasive sleeve tightening means 20 and quick release system. An abrasive sleeve 30 on most oscillating spindle sanders is tightened manually by screwing on a nut. This action requires separate tools and requires the user to guess as to what the appropriate tightness of the nut should be. The oscillating spindle sander 10 with abrasive sleeve tightening means 20 and quick release system is a system that includes flyweights 22 to automatically tighten the abrasive sleeve 30 that fits over the sanding drum 40 (see FIG. 4).

The motor 42 causes the spindle shaft 44 to oscillate or rotate. Both the motor 42 and the spindle shaft 44 are of the type commonly known to one of ordinary skill in the art. Attached to the spindle shaft 44 is a spider gear 26 that is anchored to the spindle shaft 44 via a bolt, rivet or similar means 18. One of ordinary skill in the art would recognize that the spider gear 26 can also be machined directly with the spindle shaft 44. The spider gear 26 rotates with the spindle shaft 44. Dome plate 24 sits atop spider gear 26. In the preferred embodiment, the dome plate 24 does not rotate with the spindle shaft 44 and the spider gear 26. One of ordinary skill in the art would recognize that the dome plate 24 may rotate with the spindle shaft 44 and the spider gear 26 without altering its function or the intentions of the inventor. The dome plate 24 has a top flat section 50 that operates in place of the base washer found in most oscillating spindle sanders known to one of ordinary skill in the art.

In the preferred embodiment, the two flyweights 22 are coupled to the two inverted "L"-shaped metal arms 28 that are in turn connected to the spider gear 26 via two posts (not shown) that are connected to the spider gear 26. One of ordinary skill in the art would recognize that the number of flyweights 22 and thus the number of arms 28 and posts (not shown) may be increased depending on the length of the shaft 44. It is preferred that the flyweights 22, arms 28 and posts (not shown) are increased two at a time for even weight distribution, but it is envisioned that a flyweight 22 may be added one at a time provided that there is the appropriate balance provided to the device. It is preferred that the arms 28 be connected to the posts (not shown) by a rivet at pivot point 21. One of ordinary skill in the art would recognize that the arms 28 could be connected to the posts (not shown) by other means, including, but not limited to a pin. In the preferred embodiment, the rollers 23 are connected to the arms 28 by a fastener 19 at the opposite end from the flyweights 22. The rollers 23 may be of plastic, metal, or other similarly durable materials. The rollers 23 are preferably connected to the arms 28 by a rivet, although other means can be used. The rollers 23 are preferably single rollers, but they may be double rollers or ball shaped rollers, or other similarly functioning items. In the preferred embodiment, two springs 25, one spring 25 attached via a screw, rivet, etc. 27 to the first flat side 28*a* of arms 28, located on one side of the spindle shaft 44, and a second spring 25 attached via a screw, rivet, etc. 27, attached to the second flat side (not shown) of arms 28, located on the opposite side of the spindle shaft 44, keep the arms 28 and thus the flyweights 22 from overextending. The springs 25 also aid in the return of the flyweights 22 upon the motor 42 being turned off or the power to the motor 42 being terminated.

Figure 8:
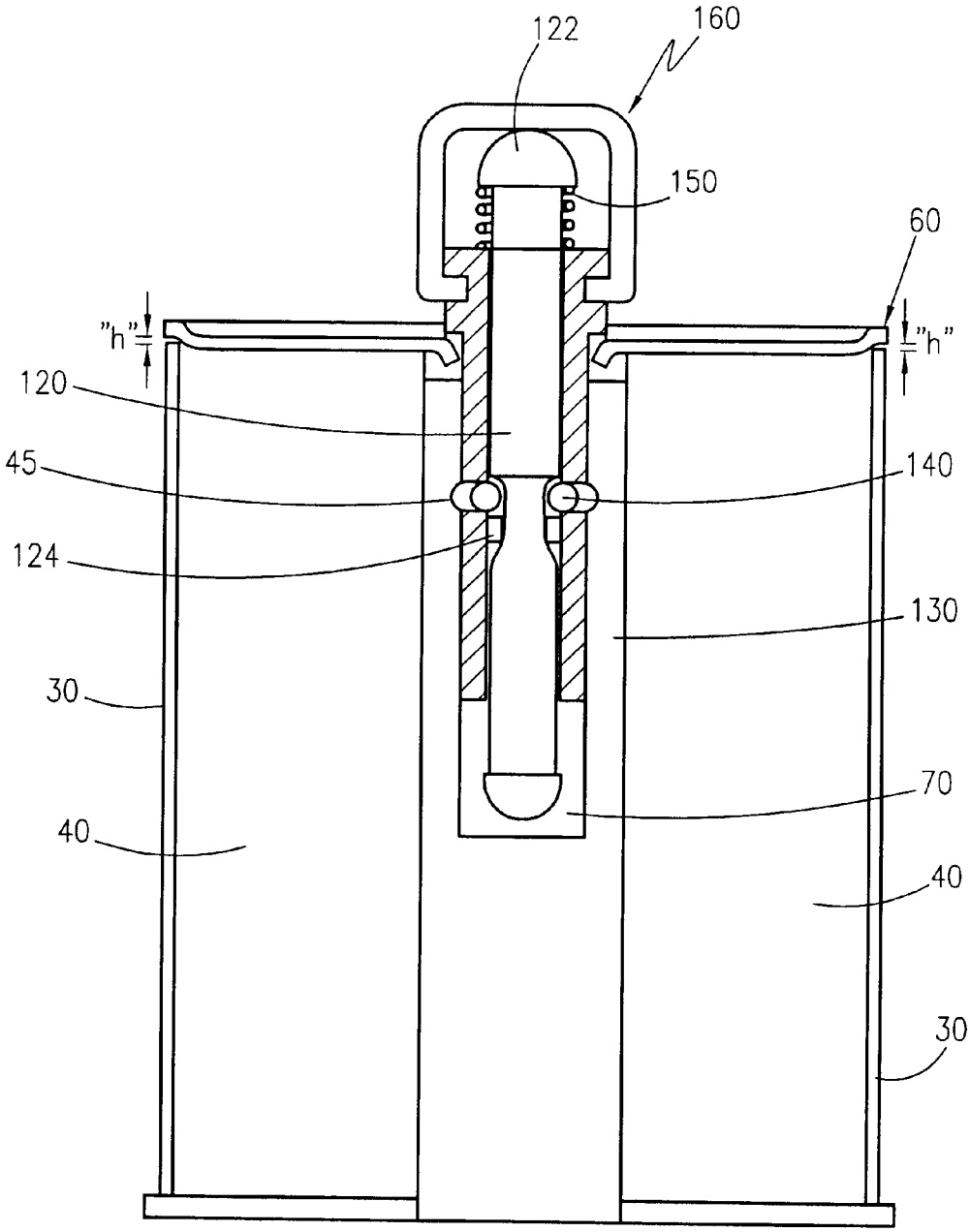
FIG. 8 is a cross-sectional view of the sanding drum and the components necessary for the quick release system taken along the line VIII—VIII of FIG. 5.
Figure 9:
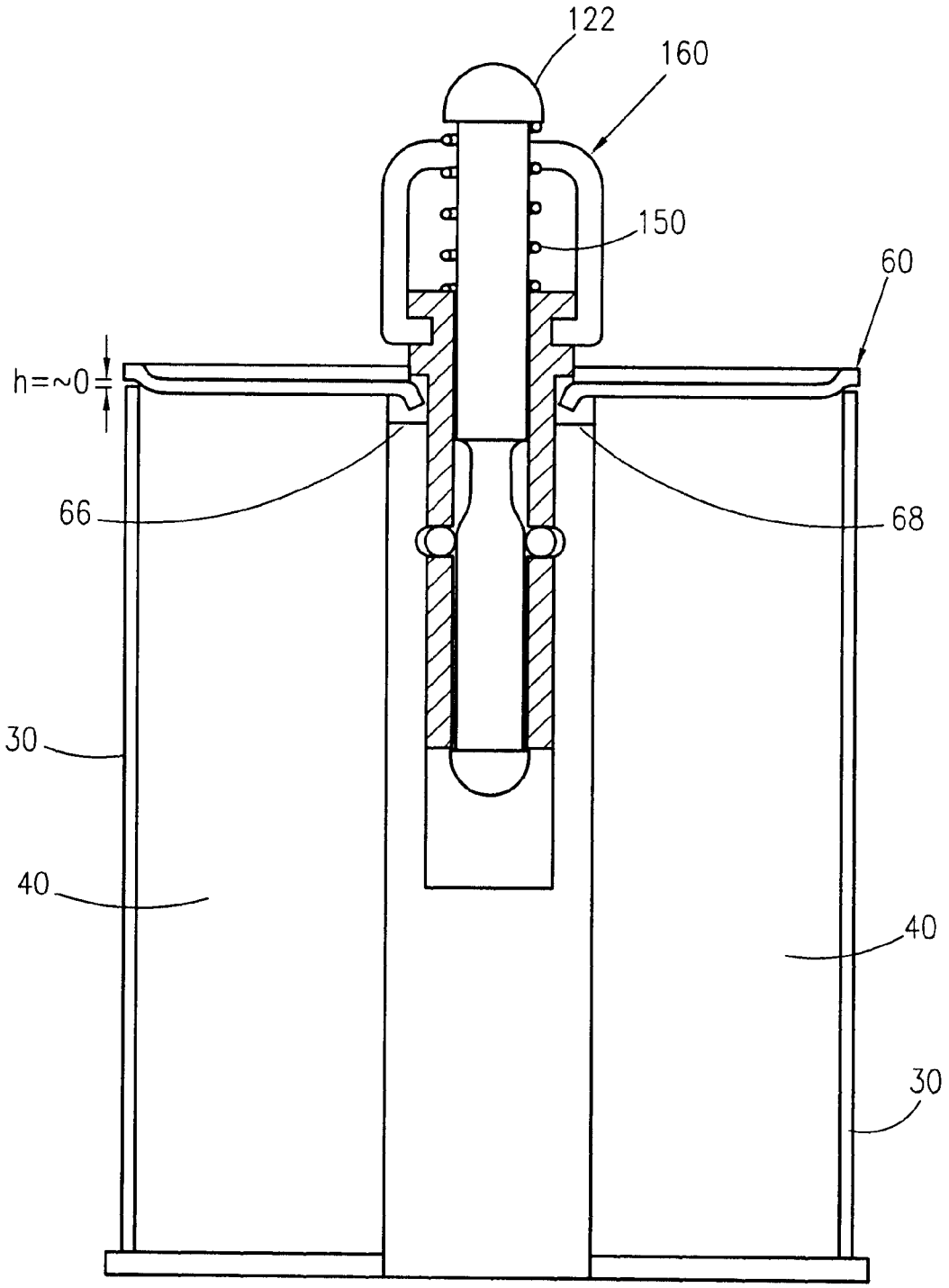
FIG. 9 is a cross-sectional view of the sanding drum, similar to that of FIG. 8 except that the height "h" between the top washer and the sanding drum is now substantially zero, thereby indicating that as the spindle shaft rotates due to the force of the motor, the top washer will engage the shaft and spin the sanding drum and the abrasive sleeve.

In the preferred embodiment, as the spindle shaft 44 rotates, centrifugal force causes the flyweights 22 to move away from the spindle shaft 44. As the flyweights 22 move away from the spindle shaft 44, the flyweights pull arms 28 out away from the spindle shaft 44 (as seen in FIG. 10). Consequently, the arms 28 pivot around pivot point 21 causing rollers 23 to roll in toward the spindle shaft 44. As the arms 28 move around pivot point 21, the rollers 23 force the dome plate 24 to move in an upward motion toward the sanding drum 40 such that the top platform 50 of the dome plate 24 pushes upward and compresses the sanding drum 40. As seen in FIG. 8, the top washer 60 and the sanding drum 40 are separated by a height "h" when the sanding drum 40 is not engaged by the top washer 60. As dome plate 24 pushes upwards on the sanding drum 40, the sanding drum 40 is compressed against top washer 60 that rotates with the spindle shaft 44 on the horizontal plane, but is prevented from moving in an upward direction either by the traditional nut, the quick release system disclosed later herein or by other similar means. The sanding drum 40 is made out of rubber in the preferred embodiment. It is readily known to one of ordinary skill in the art, however, that the sanding drum 40 may be made out of other materials that have properties similar to rubber in that it is strong, durable and pliant. As the sanding drum 40 is vertically compressed against top washer 60, it expands horizontally exerting pressure on the inside of the abrasive sleeve 30 that has been placed around the sanding drum 40, thereby compressing the initial height "h" to substantially no height between the drum 40 and washer 60 (as seen in FIG. 9). Both the sanding drum 40 and the abrasive sleeve 30 rotate with the spindle shaft 44 just as in any oscillating spindle sander known to one of ordinary skill in the art. It is preferred that the sanding drum 40 exert just enough pressure on the abrasive sleeve 30 to keep it taught against the sanding drum 40 such that the abrasive sleeve 30 does not loosen or slip when the user presses the material that needs to be sanded against the abrasive sleeve 30 while it is rotating.

In the preferred embodiment, when the oscillating sander 10 is turned off or the power to the oscillating sander 10 is removed, the motor 42 will begin to turn the spindle shaft 44 slower until it eventually stops. It is preferred that as the spindle shaft 44 turns slower, the flyweights 22 will move towards the spindle shaft 44 causing the rollers 23 to move away from the spindle shaft 44 and allowing the dome plate 24 to lower, thus releasing the compression on the sanding drum 40 and loosening the abrasive sleeve 30 so that it can be removed and replaced when necessary.

In an alternative embodiment, the abrasive sleeve tightening means 20 is adapted such that it can be fitted onto a standard oscillating spindle sander already in existence. In this alternative embodiment 20A, shown in FIG. 3, the spider gear 26 and posts (not shown) are replaced by a sheathe 16 that wraps around the spindle shaft 44. It is preferred that the sheathe 16 is fastened directly to the spindle shaft 44 via two rivets, although other fastening means could be used, and that the sheathe 16 has posts machined to connect the arms 28 thereto. To apply this alternative embodiment 20A to an existing oscillating spindle sander, one simply removes the sanding drum and the washers from the sander, sliding the automatic abrasive sleeve tightening means 20A over the shaft, tightening the rivets or other fasteners to set the abrasive sleeve tightening means in place and replacing the sanding drum 40 and top washer 60. The bottom washer is operatively replaced by the top platform 50 of the dome plate 24.

As previously disclosed, the same compression concept is used in the quick release system mechanism as shown in FIG. 4 through FIG. 10. In most oscillating sanders known to one of ordinary skill in the art, the top washer 60 rotates with the spindle shaft 44 on the horizontal plane, but has a retaining nut, pin, etc. to limit its vertical movement. In an oscillating spindle sander having a quick release system, the top washer 60 is held in place by a pin assembly 110. The top washer 60 includes a pair of prongs 62 and 64 that project downward and a centralized aperture 65 through which the pin assembly 110 is inserted into the cavity 70 of the sanding drum 40. When the top washer 60 is compressed to the sanding drum 40, the prongs 62 and 64 insert into a pair of corresponding notches 66 and 68 within the shaft 44. The insertion of the prongs 62 and 64 into the notches 66 and 68 synchronizes the spinning of the shaft 44 to the spinning of the sanding drum 40 (and the attached abrasive sleeve 30). In the preferred embodiment, the spindle shaft 44 has a core section thereof removed creating a cavity 70. The cavity 70 must be large enough to allow the pin assembly 110 to slide down into the spindle shaft 44, but not too large as to compromise the strength of the spindle shaft 44. In the preferred embodiment, the quick release system mechanism is comprised of the pin assembly 110, having an inner pin 120, a housing 130, bearings 140, a spring 150 and an optional lock 160. The pin assembly 110 may be referred to as a ball locking pin, similar to locking pins currently on the market and known to one of ordinary skill in the art.

Within the cavity 70, in the preferred embodiment, is an opening, referred to herein as a shaft opening 45, cut out of the spindle shaft 44 into the internal sides of the cavity 70, sized to accommodate a portion of the bearings 140. The shaft opening 45 circumscribes an internal circumference of said shaft 44 and cavity 70. It is also envisioned that the shaft opening(s) 45 may be two independent openings cut out of the internal walls of the shaft 44 and cavity 70 and sized to accommodate the ball bearings 140. Similarly, in the pin assembly 110, two portions of the inner pin 120 are removed. These removed portions are referred to herein as pin openings 124. These pin openings 124 are sized to accommodate the bearings 140 such that only a small portion of the bearings 140 is allowed to exit the pin openings 124.

The pin assembly 110 is inserted into the cavity 70. If the user gets an item (such as hair, clothing, an appendage or other items) caught in the spinning sander, the user need only press down on the inner pin head 122 far enough to allow the widest portion of pin openings 124 to align with the shaft openings 45 so that the small portion of the bearings 140 that is being held in the shaft openings 45 can slip out of the shaft openings 45 and into the pin openings 124 allowing the housing 130 to move in a very slight upward direction, away from the motor 42, slightly releasing the top washer 60, allowing the sanding drum 40 to expand vertically, thus creating a very slight release of compressive pressure from the sanding drum 40 on the abrasive sleeve 30. This process releases just enough pressure for the abrasive sleeve 30 to come loose along with the item caught within the sander. This method does not cut power to the oscillating spindle sander 10, but instead acts as a quick release for the user to get away from the oscillating spindle sander 10 before the user is seriously hurt. When the oscillating spindle sander 10 is off, the pin assembly 110 allows the user to quickly release and change the abrasive sleeve 30.

Figure 10A:
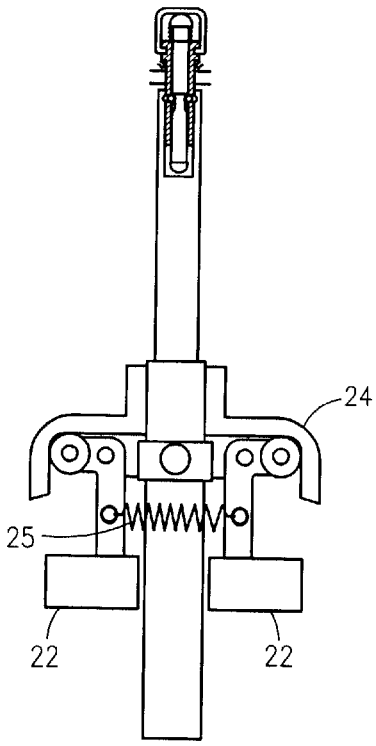
Figure 10B:
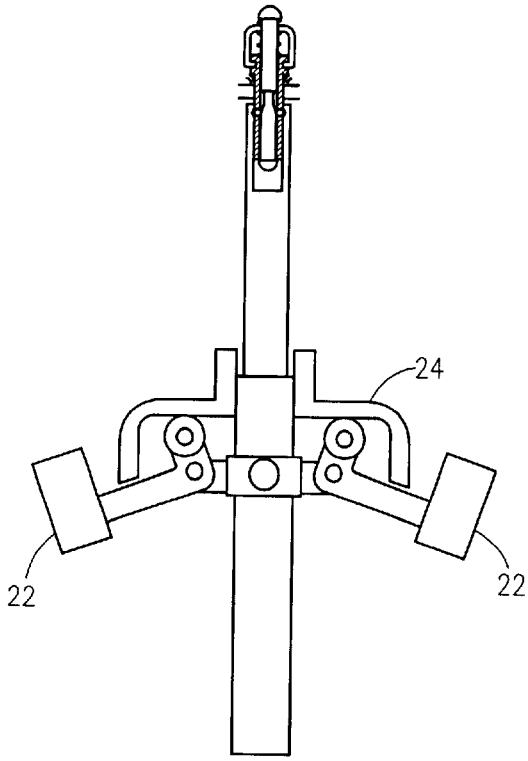

In the preferred embodiment, the lock 160 is used to keep the inner pin 120 down so that the pin openings 124 remain in line with the shaft openings 45. When the inner pin 120 is compressed, the lock 160 is flipped up to cover the inner pin head 122 and hold the pin head 122 down. To release the inner pin 120 simply push down on the inner pin head 122, flip the lock 160 down, and release the inner pin 122. It is envisioned that one embodiment of the lock 160 may be a pivoting ring (as shown), that may be pivoted between an engaged position (FIG. 10*a*) And a disengaged position (FIG. 10*b*).

2. Operation of the Preferred Embodiment

To use the present invention, a user will place the quick release pin assembly 110 into the cavity 70. To lock the pin assembly 110 so as not to engage the sanding drum 40 with the shaft 44, the pin assembly 110 is compressed downward so as to release the ball bearings 140 from the shaft openings 45 via the pin openings 124. The pin assembly 110 may be secured in this position by pivoting of the ring 160 so that a horizontal cross member of the ring 160 rests across the diameter of the pin head 122, thereby impinging the outward movement of the pin assembly 110 that is urged by the spring 150.

To engage the sanding drum 40 with the shaft 44, a user simply will release the pin assembly 110 by pivoting the ring 160 from impinging the pin assembly 110. The spring 150 will urge the pin assembly 110 upward, and the shaft walls will urge the ball bearings 140 into the shaft openings 45, thereby impinging the pin assembly 110 into a fixed and engaged position. When the motor 42 is actuated, the shaft 44 will turn, causing the flywheels 28 to move outward and force the dome plate 24 upward. The upward force of the dome plate 24 causes the flat section 50 to engage the lower portion of the sanding drum 40, compressing the sanding drum 40 toward the engaged top washer 60. The pin assembly 110 prevents the top washer 60 from popping out, thus, the sanding drum 40 is compressed therebetween, causing the abrasive sleeve 30 (attached to the exterior of the drum 40) to rotate and allow for sanding.

If an item or object becomes caught in the sander, the user may simply apply sufficient force to the pin assembly 110 to cause a downward shift of the pin assembly 110 so that the ball bearings 140 release from the shaft openings 45, thereby momentarily disengaging the sanding drum 40 from the shaft 44, thus allowing for extraction of the item or object. To re-engage, the user will stop the motor 42 and re-position the top washer 60 and the prongs 62 and 64 into the notches 66 and 68. Then, the motor 42 may be switched on again, thereby restarting the oscillation of the sander.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A quick release system for an oscillating spindle sander comprising:

a linearly elongated shaft inserted and housed within a cavity of a sanding drum;

a top washer comprising a central aperture and a pair of downwardly projecting prongs aligned about a circumference of said central aperture; and a pin assembly insertable into said shaft to impinge said top washer within said sanding drum, thereby compressing an abrasive sanding sleeve placed onto said sanding drum and permitting sanding of an object when said sander is engaged, said pin assembly releasable from said shaft to eject impingement and disengage said sander and said abrasive sanding sleeve.

2. The quick release system for an oscillating spindle sander of claim 1, wherein said shaft is in communication with and rotated by a sanding motor, said shaft supporting and rotating said abrasive sanding sleeve in response to rotation by said sanding motor.

3. The quick release system for an oscillating spindle sander of claim 1, wherein said shaft comprises a pair or notches formed at an upper end of said shaft.

4. The quick release system for an oscillating spindle sander of claim 3, wherein said pair of notches are positioned adjacent to said top washer so as to receive said pair of prongs within said pair of notches.

5. The quick release system for an oscillating spindle sander of claim 1, wherein said shaft comprises a shaft opening formed about an internal circumference of said shaft.

6. The quick release system for an oscillating spindle sander of claim 5, wherein said shaft opening receives a pair of ball bearings to impinge said pin assembly within said shaft.

7. The quick release system for an oscillating spindle sander of claim 1, wherein said central aperture is aligned with said shaft.

8. The quick release system for an oscillating spindle sander of claim 1, wherein said pin assembly comprises:

a linearly elongated body having a pin head and pin tail;

a pair of recessed pin openings formed approximate to a middle portion of said body; and an outwardly biased spring, said spring intermediate between said pin head and said top washer.

9. The quick release system for an oscillating spindle sander of claim 8, wherein said pin head compresses said spring when said pin assembly is inserted through said spring and into said shaft.

10. The quick release system for an oscillating spindle sander of claim 8, wherein said pair of recessed openings receive ball bearings when said pin assembly is pressed downward, receipt of said ball bearings releasing impingement of said top washer from said sanding drum, thereby minimizing rotation of said sanding drum and allowing extrication of items entangled in said sanding drum.

11. The quick release system for an oscillating spindle sander of claim 1, wherein release of said pin assembly and removal of said top washer permit immediate removal of said abrasive sanding sleeve, thereby permitting inversion of said abrasive sanding sleeve and extend the useful life of said abrasive sanding sleeve.

* * * * *